US005152412A

United States Patent [19]

Iler

[11] Patent Number: 5,152,412

[45] Date of Patent: Oct. 6, 1992

[54] TAMPER EVIDENT CLOSURE USING MICROCAPSULES

[75] Inventor: Howard D. Iler, Wheaton, Ill.

[73] Assignee: Continental White Cap, Inc., Downers Grove, Ill.

[21] Appl. No.: 553,649

[22] Filed: Jul. 18, 1990

[51] Int. Cl.[5] ..... B65D 55/02

[52] U.S. Cl. ..... 215/230; 215/270

[58] Field of Search ..... 215/203, 227, 230, 262, 215/270, 271, 230, 270; 220/359, 260

[56] References Cited

U.S. PATENT DOCUMENTS

| | | | |
|---|---|---|---|
| 2,131,774 | 10/1938 | Waring | 215/341 X |
| 2,131,775 | 10/1938 | Waring | 215/341 X |
| 3,736,899 | 6/1973 | Manske | 215/230 X |
| 3,896,965 | 7/1975 | Cornell | 220/359 |
| 3,935,960 | 2/1976 | Cornell | 220/260 |
| 4,424,911 | 1/1984 | Resnick | 215/230 X |
| 4,480,760 | 11/1984 | Schonberger | 215/230 |
| 4,489,841 | 12/1984 | Thompson | 215/230 X |
| 4,533,059 | 8/1985 | Kapolas et al. | 215/271 X |
| 4,678,082 | 7/1987 | Fillmore | 215/230 X |
| 4,765,498 | 8/1988 | Rafferty | 215/230 |
| 4,877,143 | 10/1989 | Travisano | 215/230 |
| 4,957,211 | 9/1990 | Ekkert et al. | 215/230 |
| 5,022,545 | 6/1991 | Carson | 215/230 |

*Primary Examiner*—Stephen Marcus
*Assistant Examiner*—Vanessa Caretto
*Attorney, Agent, or Firm*—Lockwood, Alex, FitzGibbon & Cummings

[57] ABSTRACT

This relates to the provision of a vacuum identifying button of a conventional closure for containers with encapsulated microcapsules containing a suitable dye. While the button is in its depressed, concave configuration, a coating surrounding the microcapsules is cured and caused to bond to the microcapsules. When the button everts to project upwardly and have a convex configuration, the coating is tensioned causing the microcapsules to rupture and release the color forming dye materials thereof. If desired, the evidence of button flipping or tampering may merely be in the form of a colored area, such as a stripe. In a modification, the effected colored areas may be in a design to present a warning or message. For example, a simple message such as "OPENED" may be effected.

15 Claims, 1 Drawing Sheet

FIG.1
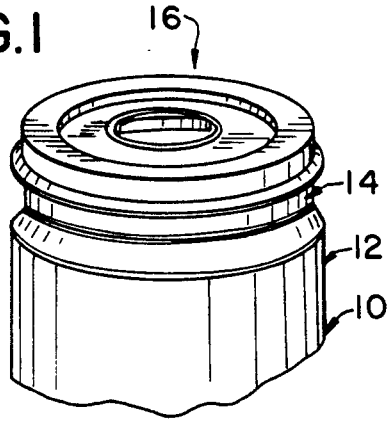
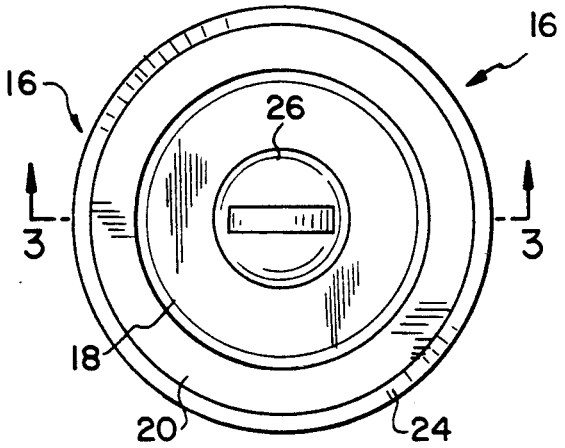
FIG.2
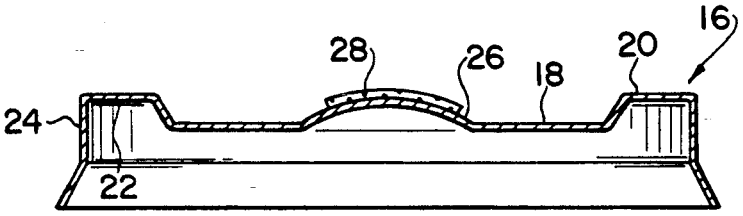
FIG.3
FIG.4
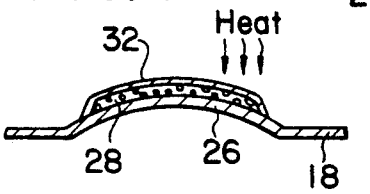
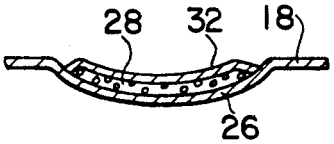
FIG.5
FIG.9
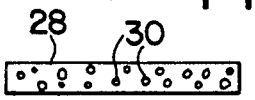
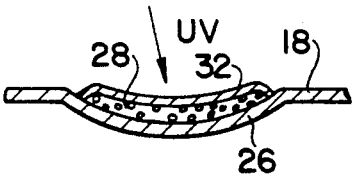
FIG.6
FIG.7
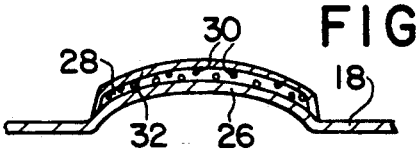
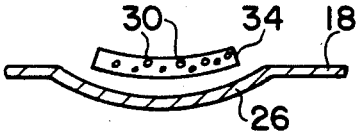
FIG.10
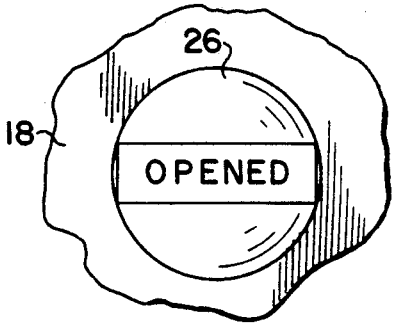
FIG.8

TAMPER EVIDENT CLOSURE USING MICROCAPSULES

This invention relates in general to new and useful improvements in closures particularly intended to be used in conjunction with vacuum packed products and including an end panel having a tamper evident button which initially projects outwardly from the end panel and which is retracted by the vacuum drawn within the package to indicate tampering particularly by way of loss of the vacuum due to opening of the package. This invention particularly relates to an improvement over such a conventional closure by providing the button with rupturable microcapsules which contain reactant materials for defining colored areas. In a preferred embodiment, the colored areas will spell out a message such as "OPENED".

Pressure activated materials have been developed by Minnesota Mining and Manufacturing Company of St. Paul, Minn. These developments are the subject of U.S. Pat. Nos. 3,935,960; 4,685,578 and 4,714,656. Of these, U.S. Pat. No. 3,935,960 particularly relates to an indicator layer which changes color when flexed thereby indicating whether the closure has been handled or tampered with. This invention, in general, relates to the utilization of a material similar to that found in this patent.

In accordance with this invention, the microcapsules are set in a coat which, when cured, is tightly bonded to the microcapsules so that when the coat is tensioned, as occurs when the closure button goes from a retracted concave position to a projecting convex position, the microcapsules will rupture with a mixing of the materials therein to form a colored area or areas. Preferably the colored areas are so arranged so as to define a message such as "OPENED".

This disclosure relates generally to two forms of the invention, both of which do not become set until after the closure has been applied to a container to form a vacuum packed package with the button being drawn downwardly generally into the container.

With the above and other objects in view that will hereinafter appear, the nature of the invention will be more clearly understood by reference to the following detailed description, the appended claims, and the several views illustrated in the accompanying drawings.

FIG. 1 is a top perspective view of a conventional type of closure to which there has been applied a tamper indicating coating in accordance with this invention.

FIG. 2 is a top plan view of the closure as initially formed with there having been applied thereto a coating containing a plurality of microcapsules.

FIG. 3 is an enlarged transverse sectional view taken generally along the line 3—3 of FIG. 2 and shows in more detail the button and the coating applied to the button.

FIG. 4 is a fragmentary sectional view showing the button with a second coating applied over the first coating and indicating an initial curing of the first coating by the application of heat.

FIG. 5 is a further sectional view taken through the center of the closure as it appears after the closure has been applied to the container and a vacuum formed in the container so as to cause the button to evert to a concave state.

FIG. 6 is a fragmentary sectional view similar to FIG. 5 and shows the coating contained in the microcapsules and the second coating as being treated by UV rays in a second curing step which will result in cross linking between the coating carrying the microcapsules and the second coating.

FIG. 7 is another fragmentary vertical sectional view showing the closure as it appears after the vacuum within the container has been released and the button has everted to its projecting convex state.

FIG. 8 is a fragmentary top plan view of the closure shown in FIG. 7 after the microcapsules have been ruptured and the material contained therein have combined so as to define a message.

FIG. 9 is an enlarged fragmentary sectional view through a typical coating containing microcapsules.

FIG. 10 is a fragmentary exploded perspective view of the conventional closure after being applied to a container and a vacuum formed therein to draw the button down and wherein the coating is to be applied to the button when in this state as shown.

Referring now to the drawings in detail, it will be seen that there is illustrated in FIG. 1 a conventional type of container, for example, a baby food jar, having an upper neck finish portion 14 of reduced diameter connected to the body of the container 10 along a shoulder 12. The container 10 is closed by a conventional closure 16 which is preferably formed of metal, but could feasibly be formed of other materials, including plastic.

Referring now to FIG. 3, it will be seen that the closure 16 includes an end panel 18 which may have a peripheral portion 20 defining a downwardly opening channel 22 for receiving a suitable sealing compound. The closure 16 also includes a depending peripheral skirt 24 which may be provided with suitable means for effecting the securement of the closure 16 to the neck finish 14.

It is to be understood that the above identified features of the closure 16 may vary from closure to closure. However, in accordance with this invention, the end panel 18 must include a button 26. The button 26 is preferably circular in outline and when the closure 16 is formed it projects convexly upwardly as is shown in FIGS. 2 and 3.

In accordance with one form of the invention, there is applied to the convex projecting button 26 a coating 28 in the form of a layer of material having incorporated therein microspheres 30 as is generally shown in FIG. 9. The coating 28 may be in the form of a binder and the microcapsules may be filled with a liquid dye precursor on the one hand and finely divided particles of material capable of reacting with the dye precursor to form a dye on the other hand. All as is generally disclosed in Cornell U.S. Pat. No. 3,935,960.

Most specifically, in accordance with this invention, the microcapsules 30 may be related to one another in a pattern so that when the capsules are ruptured, the dye will spread within the coating 28 in a predetermined pattern to present a message. This will be explained in more detail hereinafter.

It is to be understood that the capsule coating at this time is relatively soft and pliable and resistant to rupture.

Next, as is best shown in FIG. 4, a clear coat of a flexible coating is applied over the coating 28. This second coating is identified by the numeral 32 and is initially cured by the application of heat. The second clear coat 32 which will cover the microcapsules would not necessarily be a thermally cured material. It could be for example: a UV curable acrylic resin; a UV curable epoxy resin; or a two part epoxy system that would cure at room temperature or at elevated temperatures.

The closure 16, in this state, is shipped to the packer who then closes a filled container 10 with the closure 16. The resultant package will have a vacuum therein of sufficient negative pressure to draw the button 26 downwardly into the container to a concave shape as is best shown in FIG. 5. Following the normal processing of the package, at least the button area is subject to UV treatment. At this time it is to be particularly noted that the materials used to form the coating 28 and the second coating 32 are ones that a UV curing step will result in cross linking between the two materials. This is diagrammatically shown in FIG. 6. The net result is that the microcapsules are tightly bonded to the coating 28 so that when the coating 28 is placed in tension, the microcapsules will rupture and cause the formation of the colored areas described above. This will occur when the vacuum within the container 10 is released to the extent that the button 26 will evert as shown in FIG. 7. The everting of the button 26 results in the coating material 28 to be placed in tension sufficiently to rupture the microcapsules 30. As viewed in FIG. 8, the resultant colored areas will be ones which preferably will present a message such as by the word "OPENED" as shown in FIG. 8. Of course, other messages may be presented.

If desired, the invention may be of separate structure as is shown in FIG. 10. The customary closure 16 is applied to the container 10 to seal a product therein with the customary formation of a vacuum. At this time the button 26 is depressed and concaved in shape. Then there is applied to the button 26 a coating 34 containing a plurality of microcapsules 30. The material of the coating 34 is such that it remains relatively flexible after curing and also has a strong adhesive to the microcapsules 30. The coating should be clear or opaque.

The action of the button 26 flipping up on opening of the container stretches the coating 34 slightly. Since the coating 34 has strong adhesion to the capsules, this stretching should pull the capsules apart releasing their encapsulated color forming material. The coating 34 should also protect the capsules from rupture due to bumping, or other incidental contact. The stretching of the coating material caused by button flipping would be the rupture mechanism for rupturing the microcapsules 30.

Although only two preferred embodiments of the tamper identifying means have been specifically illustrated and described herein, it is to be understood that minor variations may be made therein without departing from the spirit and scope of the invention as defined by the appended claims.

I claim:

1. In a closure for use in vacuum packaging of a product, said closure having an end panel provided with a pressure activated button which button when said closure is applied to a vacuum packed container is recessed and which button when the vacuum is relieved everts to project outwardly, the improvement of providing on said button a visual indicator which is actuated when said button everts from it reversed position to its projecting position, said visual indicator being in the form of a coating having therein a plurality of microcapsules having combinable contents for forming a colored area on said button, said microcapsules being rupturable in response to the stretching of said coating, and said coating containing said microcapsules having a second coating thereover.

2. The improvement of claim 1 wherein said coating containing said microcapsules and said second coating are cross linked together by curing.

3. The improvement of claim 2 wherein said cross linking exists only when said closure is applied to a vacuum packed container and at a time when said button is recessed.

4. The improvement of claim 2 wherein said coating containing said microcapsules and said second coating are in separate states on said closure, prior to application of said closure to a container and when said button is projecting from said end panel.

5. The improvement of claim 4 wherein said cross linking exists only when said closure is applied to a vacuum packed container and at a time when said button is recessed.

6. In a closure for use in vacuum packaging of a product, said closure having an end panel provided with a pressure activated button which button when said closure is applied to a vacuum packed container is recessed and which button when the vacuum is relieved everts to project outwardly, the improvement comprising providing on said button a visual indicator coating which is actuated by stretching thereof when said button everts from its reversed position to its projecting position, said visual indicator coating being in the form of a matrix binder having a plurality of microcapsules incorporated therein, said microcapsules being sufficiently tightly bonded to said matrix binder such that when said button everts from its reversed position to its projecting position said coating is tensioned causing said microcapsules to rupture, and said coating containing said microcapsules having a second coating thereover.

7. The improvement of claim 6 wherein said visual indicator coating is colored when actuated.

8. The improvement of claim 6 wherein said visual indicator coating is in the form of a message when actuated.

9. The improvement of claim 8 wherein said message is colored.

10. The improvement of claim 6 wherein said microcapsules have combinable contents for forming a colored area on said button.

11. The improvement of claim 10 wherein said microcapsules are arranged in a pattern to present a message.

12. The improvement of claim 6 wherein said coating containing said microcapsules and said second coating are cross linked together by curing.

13. The improvement of claim 12, wherein said cross linking exists only when said closure is applied to a vacuum packed container and at a time when said button is recessed.

14. The improvement of claim 12 wherein said coating containing said microcapsules and said second coating are in separate states on said closure, prior to application of said closure to a container and when said button is projecting from said end panel.

15. The improvement of claim 14 wherein said cross linking exists only when said closure is applied to a vacuum packed container and at a time when said button is recessed.

* * * * *